US008850718B2

(12) United States Patent
Lubart

(10) Patent No.: US 8,850,718 B2
(45) Date of Patent: Oct. 7, 2014

(54) SHOE WITH SUPPORT SYSTEM

(75) Inventor: Randy Lubart, Palm Beach Gardens, FL (US)

(73) Assignee: Shoes for Crews, LLC, West Palm Beach, FL (US)

( * ) Notice: Subject to any disclaimer, the term of this patent is extended or adjusted under 35 U.S.C. 154(b) by 873 days.

(21) Appl. No.: 12/565,383

(22) Filed: Sep. 23, 2009

(65) Prior Publication Data

US 2011/0067268 A1 Mar. 24, 2011

(51) Int. Cl.

| | |
|---|---|
| ***A43B 7/16*** | (2006.01) |
| ***A43B 13/18*** | (2006.01) |
| ***A43B 21/28*** | (2006.01) |
| ***A43B 13/20*** | (2006.01) |
| *A43B 13/12* | (2006.01) |
| *A43B 21/26* | (2006.01) |
| *A43B 13/10* | (2006.01) |

(52) U.S. Cl.

CPC ..... *A43B 13/20* (2013.01); *A43B 13/12* (2013.01); *A43B 21/26* (2013.01); *A43B 13/10* (2013.01); *A43B 13/125* (2013.01); *A43B 21/28* (2013.01)

USPC ..... 36/28; 36/31; 36/25 R; 36/103; 36/107

(58) Field of Classification Search

CPC ..... A43B 13/125; A43B 13/20; A43B 13/10; A43B 13/12; A43B 13/18; A43B 21/26; A43B 21/28

USPC .... 36/25 R, 28, 31, 35 R, 107, 103, 3 A, 3 B, 36/3 R, 29

See application file for complete search history.

(56) References Cited

U.S. PATENT DOCUMENTS

| | | | | |
|---|---|---|---|---|
| 5,138,776 | A | 8/1992 | Levin | |
| 5,179,791 | A | 1/1993 | Lain | |
| 5,224,277 | A * | 7/1993 | Sang Do | 36/27 |
| 5,381,608 | A | 1/1995 | Claveria | |
| 5,636,456 | A | 6/1997 | Allen | |
| 5,701,686 | A | 12/1997 | Herr et al. | |
| 6,029,374 | A | 2/2000 | Herr et al. | |
| 6,038,790 | A * | 3/2000 | Pyle et al. | 36/30 R |
| 6,115,944 | A | 9/2000 | Lain | |
| D433,792 | S | 11/2000 | Cockrell | |
| 6,389,713 | B1 * | 5/2002 | Kita | 36/30 R |
| 6,497,057 | B1 * | 12/2002 | Lee et al. | 36/35 R |
| 6,915,598 | B2 | 7/2005 | Grisoni et al. | |
| 6,968,637 | B1 | 11/2005 | Johnson | |
| 7,082,704 | B2 * | 8/2006 | Throneburg et al. | 36/91 |
| 7,395,613 | B2 * | 7/2008 | Schoenborn et al. | 36/28 |
| 7,421,805 | B2 * | 9/2008 | Geer | 36/25 R |
| 7,464,489 | B2 * | 12/2008 | Ho | 36/28 |
| 7,565,754 | B1 * | 7/2009 | Acheson et al. | 36/28 |
| 7,954,257 | B2 * | 6/2011 | Banik | 36/28 |
| 8,056,261 | B2 * | 11/2011 | Nakano et al. | 36/28 |
| 2005/0268489 | A1 | 12/2005 | Austin | |
| 2008/0263899 | A1 | 10/2008 | Lee | |

* cited by examiner

*Primary Examiner* — Jila M Mohandesi
(74) *Attorney, Agent, or Firm* — McHale & Slavin, P.A.

(57) ABSTRACT

A shoe construction utilizing a fluid containing chamber as a cushion. The shoe includes a stabilizer positioned in the shoe and having a heel portion in overlying relation to the cushion and a forward portion in overlying relation to at least a mid-foot portion of the shoe bottom. The forward portion extends across a substantial portion of the inside width of the shoe where it is located to resist deformation of the shoe bottom under load from a user both in lateral bending and longitudinal torsion.

11 Claims, 3 Drawing Sheets

SHOE WITH SUPPORT SYSTEM

FIELD OF INVENTION

A shoe construction with a support system. The shoe has a heel cushion with an overlying support secured in the shoe in at least the heel portion and midfoot portion of the shoe to resist torsional twisting and longitudinal flexure of the shoe.

BACKGROUND OF THE INVENTION

Shoes with improved comfort are sought after by consumers and thus comfort is a goal of shoe suppliers. Comfort is provided in three basic ways, materials of manufacture, shoe shape and cushioning. In addition to comfort, shoes worn at work sites are constructed to provide an extra margin of safety. Some safety features include hard safety toes and slip resistance. Slip resistance is an important feature in shoes worn at certain work sites such as restaurants where liquids such as oil and water are frequently on the floors in areas where workers walk and stand. In addition to these functional features, style can also be important particularly in areas where the public visits. Shoe shape though takes into consideration style of shoe. One popular style is the so-called clog which has a large toe box and is of a slip on style.

Cushioning can be provided by the insole, midsole and outsole with suitable materials of construction. Although soft soles provide comfort, they tend to be very flexible. Many of these components are made of a cellular or foam material. In addition, air cushions have been used in the heel area of the shoe particularly to reduce impact forces. The cushioning is used to reduce impact on the shoe user during use of the shoe, particularly during fast walking and running where the heel of the user first impacts the underlying surface. One problem with air cushions is that movement of entrapped air inside the cushion in one area causes other areas of the cushion to accommodate that movement, e.g., if one area is compressed, another area expands in a flexible fluid filled cushion. This cushion deformation is commonly referred to as transfer of motion. This movement of fluid is particularly present in large single chamber cushions. One means of reducing this reactive cushion deformation is to provide columns extending between and connected to the upper and lower surfaces of the cushion. Transfer of motion can result in a feeling of instability if the deformation of the cushion is along a side edges of the cushion.

Another solution to the cushion deformation is the use of a plurality of cushions in the heel area that will limit fluid movement and hence transmission of deformation, keeping deformation more localized. This however is reputed to limit the cushion effect and increases the cost and complexity of a shoe. There is thus a tradeoff between cushion stability and the cushioning effect.

Another problem with shoes of comfort, is their flexibility both laterally and longitudinally. Longitudinal flexure (bending in an area transverse to the longitudinal axis of the shoe) can be somewhat controlled by use of a shank in the heel area and midfoot area of the shoe. Flexure can also be limited by the use of thick, heavy and rigid soles instead of soft flexible soles but at the cost of comfort to the wearer.

There is thus a need for an improved shoe construction to overcome the problems attendant with the use of fluid cushioned shoes using lightweight flexible materials of construction.

SUMMARY

The present invention involves the provision of a shoe with an upper with a forefoot portion, midfoot portion and heel portion. The shoe also includes a shoe bottom member also with a forefoot portion, midfoot portion and heel portion positionally corresponding to the mentioned shoe portions. The bottom member can include an outsole portion and a midsole portion. A midsole is provided in overlying relation to at least a portion of the outsole heel portion. The midsole can be used to provide elevation of a users heel in the shoe as would a separate heel. A cushion member is located in the midsole in overlying relation to the heel portion of the outsole portion that extends over at least about one-half of the interior width of the heel portion of the upper. A relatively rigid support member is provided and has a heel portion and a forward portion. The support member heel portion is secured in overlying relation to at least a portion of the cushion member and covers a substantial portion of the width of the cushion member. The support member forward portion has a maximum width greater than the maximum width of the support member heel portion and extends forwardly therefrom along a substantial portion of the midfoot portion of the shoe bottom member to provide a rigid foot support platform for the shoe.

BRIEF DESCRIPTION OF THE DRAWINGS

Like numbers used throughout this application represent like or similar parts and/or construction.

DETAILED DESCRIPTION OF THE INVENTION

Figure 1:
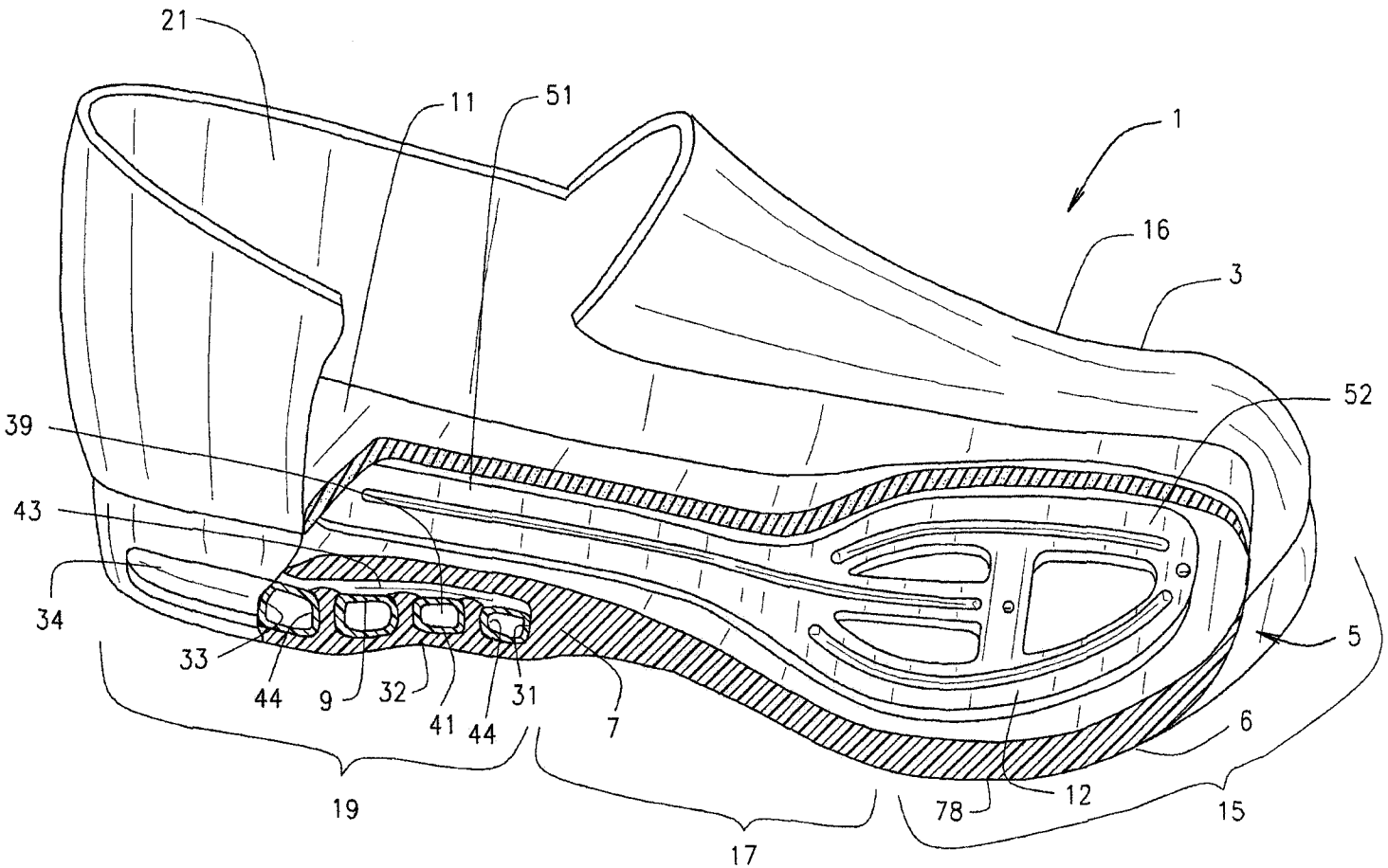
FIG. 1 is a fragmentary perspective view of a shoe of the invention showing internal structure of the shoe.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

The reference numeral 1 indicates generally a shoe construction which, for convenience is shown as a clog type shoe although the invention is usable with any suitable shoe style. The shoe 1 is shown as a slip on type shoe that uses no auxiliary cinching device, such as a shoe string, to assist in securing the shoe to a foot. Generally, the shoe includes an upper 3, an bottom member 5 with and outsole portion 6 and a midsole portion 7 with a cushion member 9 therein. The shoe can also include an insole 11. A support member 12 is associated with the cushion 9 and the bottom 5 as hereinafter described.

The upper 3 can be made of any suitable material or combination of materials such as leather, fabric, polymers or the like as is known in the art. The shoe 1 and the upper 3 have a forefoot portion 15, a midfoot portion 17 and a heel or hindfoot portion 19. These parts of the shoe and upper correspond and generally contain the similarly named parts of the foot. The forefoot of the foot is composed of the five toes (called phalanges) and their connecting long bones (metatarsals). The midfoot is composed of the irregularly shaped tarsal bones, forms the foot's arch, and serves as a shock absorber. The hindfoot is composed of three joints and links the midfoot to the ankle (talus). In a preferred embodiment, the upper 3 is of a slip on type, such as a clog. Such a construction typically provides a loose fit of the shoe to a foot and provides for ease of foot entry and exit. A loose fit may also improve ventilation of the shoe during use. The upper 3 has a foot receiving opening 21 and as shown, the upper has an enclosed toe box 16 in the forefoot portion 15 and midfoot portion 17. The upper 3 may be lined or unlined as desired. A suitable lining can be fabric, fabric plus foam or leather as are known in the art.

In a preferred embodiment, the shoe 1 is provided with an insole 11 that can extend the full length or a portion of the length and preferably the full width of the interior of the shoe. The insole 11 can be made of any suitable material or combination of materials such as leather, fabric, polymeric or elastomeric foam and can be permanently secured in place as by cementing or can be removable as is known in the art.

The shoe 1 includes a bottom, 5 that can be of any suitable form. The bottom 5 may be of single or multiple piece construction and is suitably secured to the upper 3 as by stitching and/or cementing. The bottom 5 can be molded construction and could be molded onto the upper 3 forming a molded integral structure. The bottom 5, like the upper 3, has a forefoot portion 15, a midfoot portion 17 and a hindfoot portion 19. The hindfoot portion 19 contains the midsole portion 7 and the cushion 9. The bottom 5 can be made of leather, elastomer, polymer or combinations thereof depending on the method used to assemble a shoe. The bottom 5 can be of a cellular material if desired for softness and lightness and particularly preferred for work shoes is an outsole portion 6 that is oil resistant and slip resistant. An example of such an outsole is disclosed in U.S. Design Patent 433,792 assigned to the assignee of the instant invention.

The bottom 5 is provided with a midsole portion 7 particularly in the areas of the hindfoot portion 19. The midsole portion 7 is shown as integral with the outsole portion 6 and is positioned between the outsole portion 6 and the insole 11 if an insole is provided. The midsole portion 7 overlies the hindfoot portion 19 of the outsole portion 6 and underlies the hindfoot portion 19 of the insole 11. A bottom bed liner (not shown), such as a paperboard layer, can be positioned and secured in the shoe 1 in overlying relation to the interior portion of the bottom 5. The midsole 7 can function as a heel lift to elevate the hindfoot portion 19 of the insole 11. The midsole portion 7 of the present invention provides a mounting area for the cushion member 9 as described below. The midsole portion 7, in the illustrated embodiment, houses the cushion member 9 having a pocket 31 therein for the cushion member. The outsole portion 6 can form a bottom wall 32 for the pocket 31 and the midsole portion 7 can form the sidewalls 33 of the pocket 31. A port 34 can be provided in heel area of the sidewall 33 so the cushion 9 is exposed for viewing. The midsole portion 7 can be made of any suitable material or combination of materials that preferably provide resilient cushioning such as an elastomeric or polymeric foam. The midsole portion 7 can be secured in place as by stitching, cementing or encapsulation in other shoe components if it is made separate from the outsole portion 6.

The cushion member 9 is positioned in the pocket 31 and is positioned to underlie a portion of the heel portion 19 of the upper 3 and overlie a heel portion of the outsole 6 to provide cushioning support for the heel area of a shoe wearer. The cushion 9 can be molded in place in the bottom 5 if desired. The cushion member 9 extends laterally across the heel portion 19 of the upper 3 and preferably at least about one-half the interior width of the heel portions 19 for a substantial portion of the length of the heel portion 19. The cushion member 9 is resiliently deformable and is soft to provide cushioning for a user's foot in the shoe 1. In a preferred embodiment, the cushion member 9 contains a fluid, preferably one or more gases such as air. The cushion member 9 has at least one sealed chamber 39 formed by a bottom wall 41, sidewall 42 and top wall 43 to contain the fluid therein. Preferably the walls 41-43 of the cushion member 9 are made of a polymeric material such as polyethylene, polypropylene or polyurethane that will contain the fluid for an extended period of time of use. The cushion member 9 can have more than one chamber 39 and at least one chamber preferably extends across a substantial portion of the cushion and the heel portion 19. More preferably, a chamber 39 extends laterally across at least one-half of the width of the heel portion 19 where the chamber 39 is located at least at the widest part of the chamber 39. The cushion 9 also extends lengthwise of the heel portion 19 a substantial portion of the length thereof and preferably at least about one-half the length of the heel portion 19. In a particularly preferred embodiment, there is a single cushion 9 with a single main chamber 39 in a shoe 1. The cushion 9 can be provided with a plurality of upright columns 44 extending between and secured to the bottom and top walls 41, 43. The columns 44 can be formed hollow and when the cushion 9 is molded in place in the bottom 5, can receive bottom material therein. The cushion 9 is suitably mounted in a pocket 31 and occupies a substantial portion of the volume thereof and preferably, substantially all of the volume of the pocket 31. The chamber 39 may be pressurized or at about ambient pressure when not loaded by a shoe user. If the cushion 9 is sealed, it would thereby be pressurized when a user places load on it during use.

Figure 2:
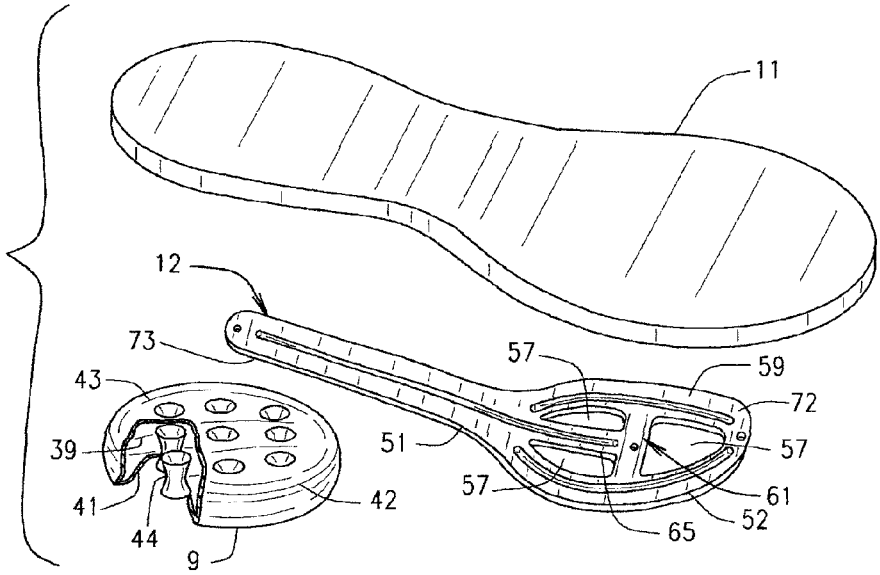
FIG. 2 is an exploded perspective view of the insole, cushion and associated support member.
Figure 3:
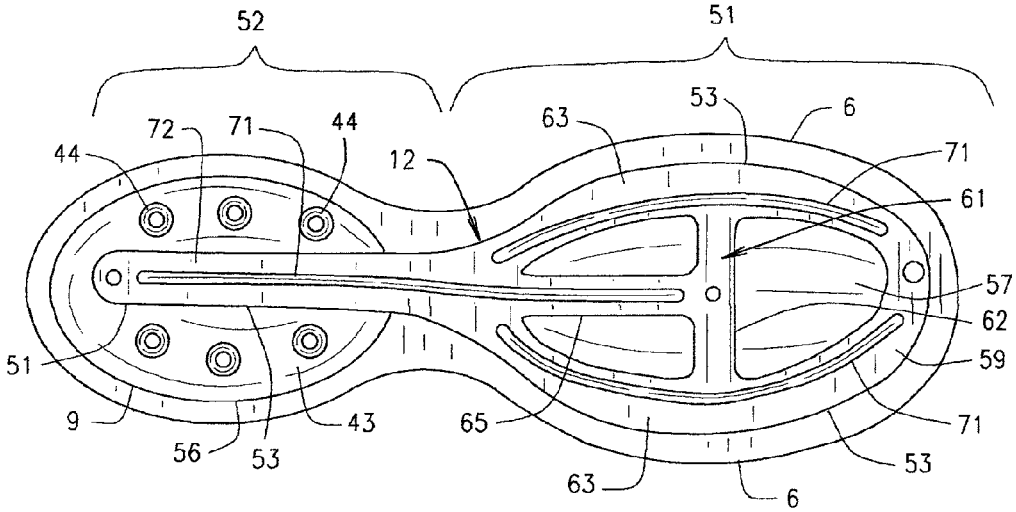
FIG. 3 is an enlarged plan view of a support member in overlying relation to the cushion and outsole.
Figure 4:
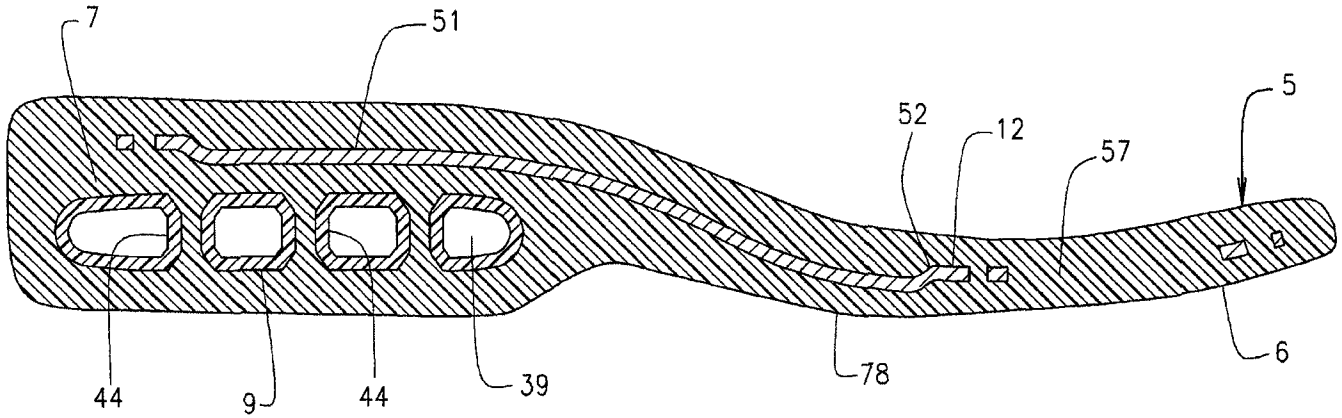
FIG. 4 is a side sectional view of a form of the invention with the support member shown embedded in the shoe bottom.

A support member 12 (FIGS. 2, 3) is provided in a shoe 1. One function of the support member 12 is to provide a relatively rigid foot support platform on the top of at least a portion of the cushion 9 and in at least the midfoot portion 17 and preferably the forefoot portion 15 to overlie the outsole 6 in these areas. The support member 12 is configured to resist torsional twisting of the bottom 5 along its length and to resist bending or flexing of the bottom laterally across the bottom. The support member 12 has a heel portion 51 and a forward portion 52. The support member heel portion 51 is positioned and secured in overlying relation to at least a portion of the cushion member 9 (FIGS. 1-3). The support member 12 can be molded into the bottom 5 for securement. Preferably, the support member is substantially encapsulated within the material making up the bottom 5 and more preferably fully encapsulated with bottom material positioned above and below the support member 12 (see FIG. 4). The can be accomplished by molding the support member 12 in place. The support member 12 preferably covers a substantial portion of the width and length of the cushion member 9. As shown, the outer perimeter defined by an outer edge 53 is within the outer perimeter of the cushion as defined by the outer edge 56 of the cushion. The heel portion 51 extends along a substantial portion of the length of the heel portion 19 of the upper 3. The heel portion 51 has a transverse width in the range of between about ⅜ inch to about 1 inch and may vary along its length. The cushion 9 can have a width at its widest point on the order of 2-3 inches depending on the shoe size and style. The support member 12 forward portion 52 is shown as having through openings 57 to help fix the position of the support member within the bottom 5. The openings 57 allows for air flow through the support member 12 in the toe box 16. The forward portion 52 extends at least over the midfoot portion 17 and, in addition, preferably over a substantial length of the forefoot portion 15. In a preferred embodiment, the forward portion 52 has an outer edge of a frame member 59 spaced inwardly of at least the interior edges of the side portions of the midfoot portion 17 and also in the forefoot portion 15 in the range of between about ½ inch and about 1 inch. The forward portion 52 is preferably generally oval shaped. The interior perimeter edges of the shoe 1 correspond generally to the outer perimeter edge of a full size insole 11. The forward portion 52 includes a web member 61 having a transverse brace member 62 extending laterally between and secured to opposite legs 63 of the frame member 59. The web member 61 can define portions of the edges of the through openings 57. The web member 61, as shown, also includes a longitudinal brace member 65 extending between rearward portions of the legs 63 and the brace member 62. The brace member 65 also defines portions of openings 57. The support member 12 also includes the forward portion 52 that extends forwardly of the heel portion 51 in the shoe 1 into the midfoot portion 17 and forefoot portion 15 of the upper 3 in overlying relation to the outsole 6. The forward portion 52 has an upper surface 72 that is concavely curved and a lower surface 73 that can be convexly curved. Preferably, the support member 12 is secured in the shoe 1 between the midsole portion 7/cushion 9 and the insole 11 in the heel portion 19 and between the outsole portion and insole 11 in the midfoot portion 17 and the forefoot portion 15. The support member 12 is relatively stiff and can be made of a resiliently deformable metal alloy such as steel or can be a molded rigid polymer. If made of steel, the thickness of the support member 12 can be on the order of about 1/32 inch to about 3/32 inch. The width of the component parts of the support member 12 is on the order of about ½ inch to about 1 inch. As shown, the support member 12 is made of a metal alloy and has formed grooves 71 extending inwardly from surface 72. The grooves 71 can be formed with a corresponding rib projecting from the surface 73 as by stamping. The ribs extend downwardly into the bottom 5 when the support member 12 is embedded in the bottom 5 as seen in FIG. 4. The heel portion 51 has a generally rectangular shaped outer perimeter and the outer perimeter of the forward portion 52 is generally oval.

The support member 12 provides resistance to the cushion deformation from side to side during loading of the cushion 9 centrally during use allowing the use a cushion with a low number of chambers 39, e.g., one or two. The forward portion 52 provides a relatively rigid platform for engagement with the forefoot portion of a foot to resist bending of the sole across the shoe 1 and is curved to provide for a substantially normal walking gait. The forward portion 52 and the heel portion 51 also limit torsional twisting or deformation of the bottom 5 about a longitudinal axis of the bottom 5. This resistance to deformation can be further increased by bonding the support member 12 to the bottom 5. It is also preferred that the bottom surface 78 of the outsole 6 in the forward portion of the midfoot region 17 and at least the rear portion of the forefoot region 15 be relatively straight extending laterally across the outsole 6 but as noted above, can be convexly curved front to rear.

It is to be understood that while certain forms of the invention are illustrated, it is not to be limited to the specific forms or arrangements herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A shoe construction including:

a shoe upper with a forefoot portion, midfoot portion and heel portion;

a bottom member, said bottom member having an outsole portion with a forefoot portion, midfoot portion and heel portion and having a midsole portion in overlying relation to at least a portion of the heel portion of the outsole portion;

a sealed air cushion member located in the midsole portion in overlying relation to the heel portion of the bottom member and extending over at least about one-half of the central portion of the interior width of the bottom member heel portion; and a resiliently deformable metal support member encapsulated into said midsole portion, said metal support member constructed and arranged to prevent said cushion member from deforming to the side and to provide torsional twisting resistance during loading of said cushion member, said support member having a heel portion and a forward portion, the support member heel portion being secured in overlying relation to the cushion member and covering a substantial portion of the length of the cushion member, the forward portion of the support member having a maximum width greater than about one-half the maximum inside width of the shoe upper at the locus of the maximum width of the forward portion to provide a rigid platform for engagement of the forefoot of the user, said forward portion extending forwardly from the support member heel portion along a substantial portion of the midfoot portion of the outsole portion, said forward portion of said support member having a frame member surrounding a through opening and also having a web member extending between and being connected to a portion of said frame member, whereby said support member provides resistance to torsional twisting about a longitudinal axis of said midsole portion.

2. The shoe of claim 1 wherein said forward portion of said support member extends into the forefoot portion of the shoe upper and extends across a substantial portion of the width of the forefoot portion of the shoe upper.

3. The shoe of claim 2 wherein said forward portion of said support member being perforated.

4. The shoe of claim 1 wherein the web member including a first member extending laterally between opposite side portions of the frame member and being connected thereto.

5. The shoe of claim 4 wherein the web member including a second member connected to and extending forwardly from the first member to the edge frame member and being connected thereto.

6. The shoe of claim 5 wherein the upper being a slip on style.

7. The shoe of claim 5 wherein said air cushion member having more than one sealed air chamber.

8. The shoe of claim 1 wherein said air cushion member having a top wall and a bottom wall with a plurality of columns secured to and extending between the top and bottom walls.

9. The shoe of claim 7 wherein said air cushion member overlying a substantial portion of the outsole portion heel portion.

10. The shoe of claim 1 wherein said support member extends along the length of the midfoot portion of the shoe upper and a substantial portion of the length of the forefoot portion of the shoe upper.

11. The shoe of claim 5 wherein said web member is constructed from a molded rigid polymer.

* * * * *